United States Patent [19]

Snellman et al.

[11] Patent Number: 4,466,606

[45] Date of Patent: Aug. 21, 1984

[54] SHEET JOGGING APPARATUS

[75] Inventors: Donald L. Snellman, 2807 W. Galer St., Seattle, Wash. 98199; Bernard A. Pearson, King County, Wash.

[73] Assignee: Donald L. Snellman, Seattle, Wash.

[21] Appl. No.: 301,597

[22] Filed: Sep. 14, 1981

[51] Int. Cl.[3] ..... B65H 31/38; B65H 31/36

[52] U.S. Cl. ..... 271/221; 271/223

[58] Field of Search ..... 271/221, 222, 223, 224, 271/238, 240, 253, 254, 255, 287; 270/58

[56] References Cited

U.S. PATENT DOCUMENTS

| | | | |
|---|---|---|---|
| Re. 30,031 | 6/1979 | Snellman | 271/222 |
| 3,388,907 | 6/1968 | Snellman et al. | 271/222 |
| 3,893,665 | 7/1975 | Greene | 271/221 |
| 3,910,568 | 10/1975 | Brown et al. | 271/287 |
| 3,949,982 | 4/1976 | Snellman et al. | 271/222 |
| 4,047,713 | 9/1977 | Snellman et al. | 271/221 |
| 4,168,832 | 9/1979 | Lewis et al. | 271/221 |

*Primary Examiner*—Bruce H. Stoner, Jr.
*Assistant Examiner*—James E. Barlow
*Attorney, Agent, or Firm*—Seed and Berry

[57] ABSTRACT

An improved sheet jogging apparatus allows for easier access and quicker maintenance by placing the primary components of the apparatus above the top panel of the bin unit of a collator/sorter. Quicker adjustment of the sheet jogging apparatus to accommodate different sizes and widths of paper is easily accomplished with a sliding shaft-slot-and-set screw means. Placing the components of the jogger on top of the panel alleviates problems of assembly where the limited space between the shelves of the bin unit and the top panel make work difficult and alleviates the problem of maintenance where the shelves must be removed for access to the components of the standard sheet jogging apparatus. A source of reciprocal motion mounted on top of the panel is connected to jogging bars which extend downwardly from the panel beside the shelves and which are capable of movement responsive to the source of reciprocal motion to jog the side edges of stacks of sheets on the shelves into alignment. A microswitch operatively associated with the jogging mechanism counts the number of jogging cycles through which the jogging bars move. A microprocessor responsive to the microswitch stops the source of reciprocal motion after a predetermined number of cycles.

17 Claims, 5 Drawing Figures

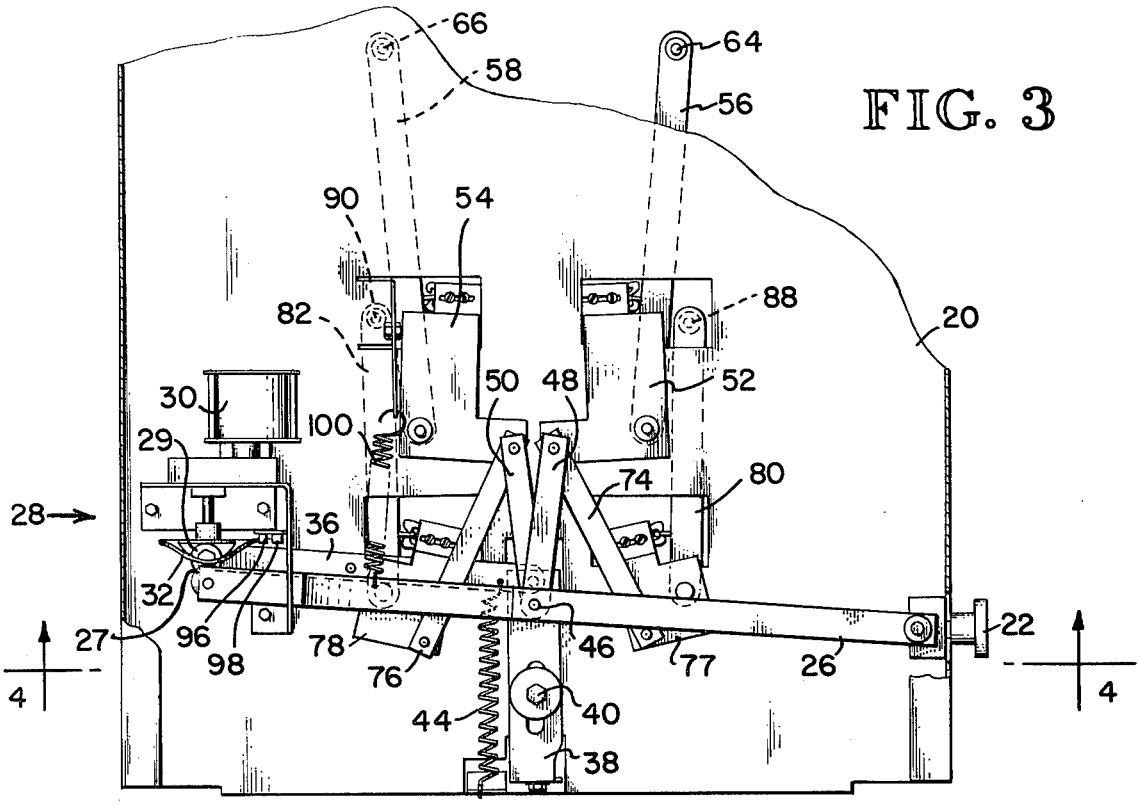
FIG. 3
FIG. 4
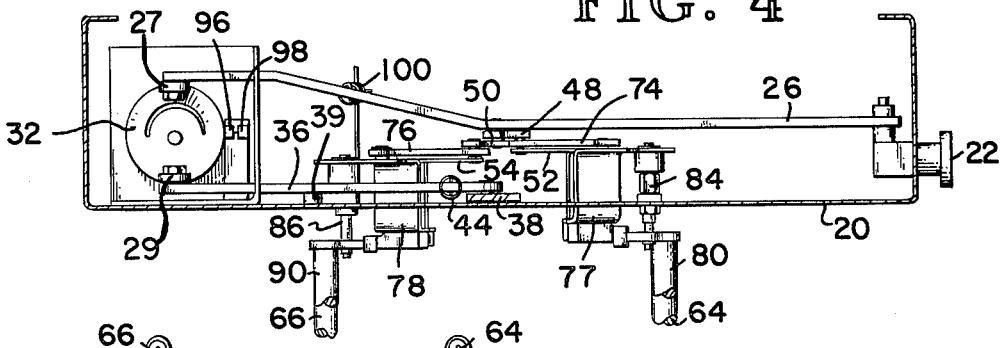
FIG. 5
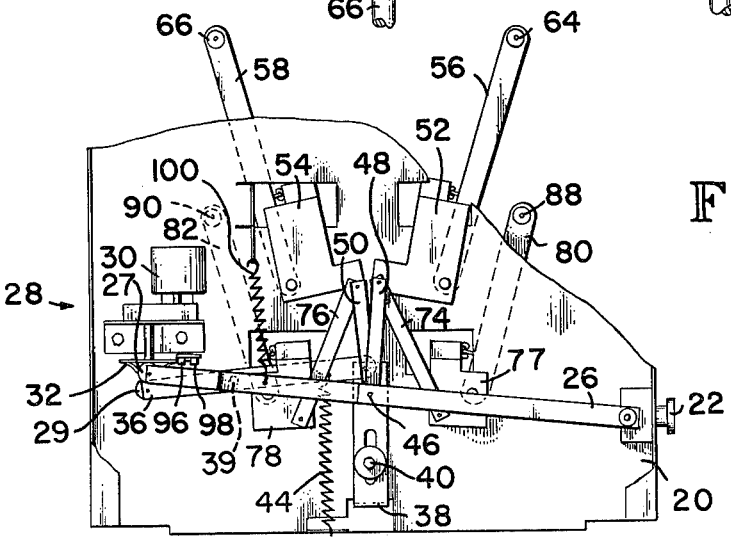

SHEET JOGGING APPARATUS

DESCRIPTION

1. Technical Field

This invention relates to an improved sheet jogging apparatus for forming uniform stacks of sheets on shelves of the bin unit of a collactor or sorter. More particularly, the invention relates to a sheet jogging apparatus which laterally taps the side edges of loosely formed stacks of sheets on the shelves of the bin unit to form neat piles of sheets.

2. Background Art

Typical sheet jogging apparatus are disclosed in U.S. Pat. No. Reissue 30,031; U.S. Pat. No. 3,388,907; U.S. Pat. No. 3,598,401; U.S. Pat. No. 4,168,832; and U.S. Pat. No. 4,047,713. These patents provide mechanisms for relatively slow adjustment of the jogger to accommodate various widths of paper, primarily relying on worm gear mechanisms to spread and reduce the distance between the arms which tap the sheets. The jogging mechanisms disclosed are also relatively difficult to maintain and to assemble because the working parts are placed either directly above the top shelf in a very confined space between the top shelf and a top panel for the bin or directly below the lowest shelf, again where the space is quite confined.

DISCLOSURE OF INVENTION

An improved sheet jogging apparatus for forming uniform stacks of sheets on shelves of a collator or sorter bin provides for much quicker adjustment of the distance between the jogging rods by using, in a preferred embodiment, a set screw-slot-and-lever mechanism to allow a quick adjustment of the width. To ease maintenance and to accelerate assembly, most working parts of the apparatus are installed above a top panel of the collator/sorter. Finally, greater control of the jogging mechanism is obtained by incorporating a microswitch and microprocessor to control the driving means of the apparatus.

In one embodiment, the improved sheet jogging apparatus of this invention comprises a panel which overlies the bin unit and houses the primary jogger components. A drive means is mounted on top of the panel and is connected to means for jogging which extend through the panel. The jogging means are capable of vibrating responsive to the drive means to jog the stacks of sheets by loosely tapping against the edges. Ordinarily, the improved sheet jogging apparatus of this invention also includes means for adjusting the distance between the jogging means so that the jogging means will function for different sizes of paper. A highly preferred means for accomplishing the adjustment in width includes a sliding shaft which crosses the bin above the panel and which extends outwardly from the collator in a horizontal slot. One end of the sliding shaft is operatively associated with the drive means for the sheet jogging apparatus, while the other end is capable of being fixed in various positions along the slot. Each position along the length of the slot corresponds to a different width for the jogging rods. Input transfer means connect the sliding shaft to the jogging means and transfer the input drive from the drive means to the jogging means. The improved sheet jogging apparatus of this invention preferably includes means for counting the number of jogging cycles through which the jogging means move as they tap against the loosely piled sheets, and means, responsive to the means for counting, for stopping the drive means after a predetermined number of jogging cycles have occurred.

BRIEF DESCRIPTION OF THE DRAWINGS

FIG. 3 is a top plan view of the sheet jogging apparatus of FIG. 2.

FIG. 4 is a sectional view taken along line 4—4 of FIG. 3.

FIG. 5 is a top plan view, similar to FIG. 3, showing the position of the various components of the apparatus at a different stage in a jogging cycle.

BEST MODE FOR CARRYING OUT THE INVENTION

Figure 1:
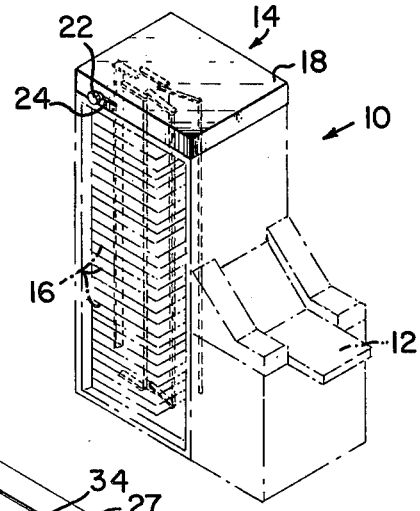
FIG. 1 is an isometric view of a collator/sorter incorporating an improved sheet jogging apparatus of this invention.
Figure 2:
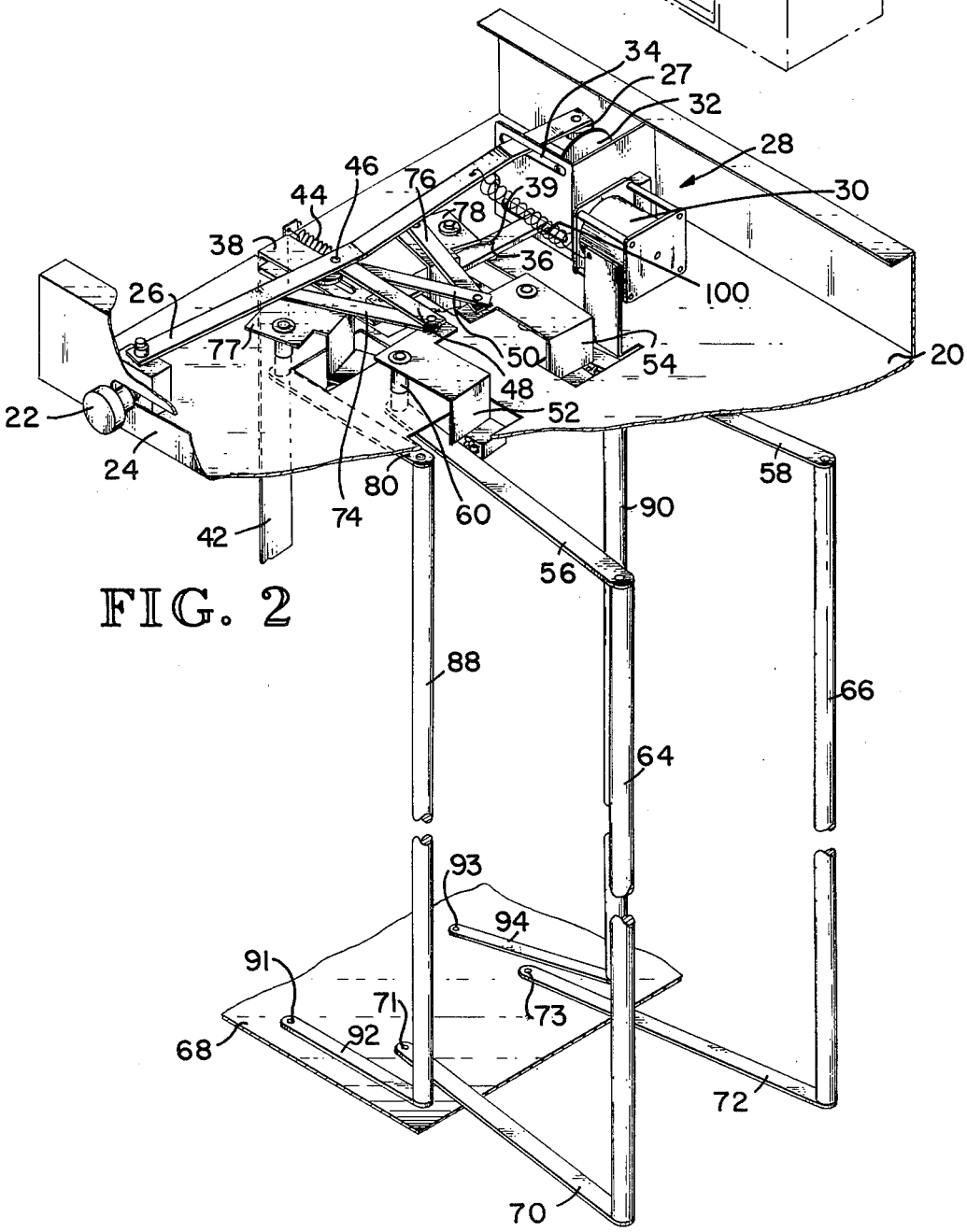
FIG. 2 is a detailed, partially cutaway isometric of an improved sheet jogging apparatus of this invention.

Referring first to FIG. 1, a collator/sorter 10 has a sheet feed means 12, ordinarily including a vacuum conveyor system, and at least one bin unit 14 including a plurality of shelves 16 into which sheets are individually inserted to form stacks. A top cover panel 18 conceals the improved sheet jogging apparatus of this invention. By removing the top cover panel 18, relatively unobstructed access is provided to the components of the sheet jogging apparatus, which primarily are mounted above a panel 20 of the bin unit 14. Quick adjustment of the width of the sheet jogging rods is easily accomplished by a set screw knob 22 which projects outwardly through a horizontal slot 24 in the side or back of the collator bin 14. Preferably, the slot 24 is calibrated to indicate the various widths of paper to which the jogging rods may be set.

Referring to the other figures, a sliding shaft 26 is pivotally connected to the set screw knob 22 and extends across the width of the bin unit 14. The opposite end of the shaft includes a cam follower 27 associated with a drive means 28 for the improved sheet jogging apparatus. The drive means 28 includes a motor 30 and a cam 32, which rotates in response to the motor 30 to move the sliding shaft laterally in a restraining slot 34 (although pivoting at the knob 22). A reduction gear box is preferably used to limit the cam's speed to about 30 rpm. Below the sliding shaft 26, an actuator shaft 36 is also operatively associated with the cam 32. The actuator shaft 36 is pivotally mounted to the panel 20 at 39. A cam follower 33 on one end of the shaft is in contact with cam 32. A pin 41 on the other end of shaft 36 connects the shaft 36 to base plate 38. The plate 38 includes a slot through which a pin 40 extends. The pin 40 is mounted to the upper surface of panel 20. The drive means 28 (through the cam 32) reciprocates the actuator shaft 36, which, in turn, reciprocates the plate 38. The plate 38 turns downwardly through an opening in the panel 20 to form a back bar 42 which taps against the ends of sheets on shelves of the bin unit when the actuator shaft 36 moves in response to the drive means 28. A spring 44 aids in retaining the actuator shaft 36 in operative contact with the drive means 28 and returns the plate 38 to its initial biased position.

A pivot 46 approximately midway along the length of sliding shaft 26 connects two arms 48 and 50 to the drive means 28 for reciprocal movement responsive thereto. The arms contact respective L-shaped plates 52 and 54, each plate having a portion which extends downwardly through an opening in the panel 20 to contact extension arms 56 and 58, which are respectively pivotally mounted to shafts 60 and 62 connected to and extending through panel 20. A fastener clips the plate to the extension arm so that the two pieces move together. However, the extension arms are disengageable from the plates. Forward jogging rods 64 and 66, connected to the free ends of extension arms 56 and 58, extend downwardly on opposite sides of the shelves of a bin unit and are connected to respective extension arms 70 and 72. The extension arms are pivotally connected at pivot points 71 and 73 to the bottom panels 68 and their respective ends. Thus, as the sliding shaft 26 moves laterally under action from the cam 32, the arms 48 and 50 reciprocate the L-shaped plates 52 and 54 to tap against the extension arms 56 and 58 to move the rods 64 and 66 into and out of contact with the loose sheets on the various shelves of the bin.

Arms 74 and 76 are pivotally connected at one end to the L-shaped plates 52 and 54 and pivotally connected at the other end to second L-shaped plates 77 and 78. Portions of the plates 77 and 78 extend downwardly through openings in the panel 20 to contact extension arms 80 and 82. Fasteners couple the plates and arms as with the forward jogging means. The arms 80 and 82, respectively, connect, at one end, to shafts 84 and 86 (which are connected to and extend through the panel 20) and, at the other end, to rear jogging rods 88 and 90 (which provide jogging action near the rearward ends of sheets on the shelves). The forward and rearward jogging rods extend the entire height of the bin unit on opposite sides of the shelves. The rearward jogging rods 88 and 90 (similar to the forward rods) are connected at their lower ends to extension rods 92 and 94, which are pivotally connected at points 91 and 93 to the bottom panel 68. Preferably, all the jogging rods 64, 66, 88 and 90 are pivotally mounted so that the jogging rods may be swung in an arc away from the shelves to allow easy access to the shelves for clearing stacks from the shelves.

Operatively associated with the cam 32, a microswitch 96 serves as a means for counting the number of jogging cycles through which the sliding shaft 26 and actuator shaft 36 move. A microprocessor 98 is operatively associated with the microswitch 96 to stop the drive means 28 after a predetermined number of cycles have been completed.

A spring 100, extending between sliding shaft 26 and plate 101 secured to the upper surface of panel 20, biases the sliding shaft into contact with the cam 32.

By sliding the knob 22 along the slot 24, the position of the pivot 46 is altered, thereby either increasing or reducing the distance between the jogging rods 64, 66, 88 and 90. Quick adjustment is possible because setting the knob is easy. The slot 24 may be serrated, although use of a smooth slot with a set screw knob is preferred. Although shown as extending out the side, the shaft could be made at an angle so that it would extend out the front or rear of the machine. Because addition of bin units in tandem is desirable, it is highly preferred to use the side positioning.

We claim:

1. A sheet jogging apparatus for forming uniform stacks of sheets resting on vertically arranged shelves of a bin unit, the bin unit having backup means extending on at least one side of the shelves against which one of the side edges of the stacks may be aligned, comprising:

a jogging apparatus including at least one jogging rod mounted on the opposite side of the shelves from the backup means and positioned for movement for contacting and aligning the side edges of the stacks of sheets, a source of reciprocal motion, linking means connecting the jogging apparatus to the source of reciprocal motion for movement of the jogging bars to and from the stacks, and a slidable adjusting means for adjusting the distance between the jogging bars and backup means to accommodate different widths of paper, including an opening along one side of the bin unit and a sliding shaft accessible through the opening and operatively associated with the linking means to move the jogging rod away from the backup means when the shaft is moved in one direction in the opening, wherein the angle of the shaft with respect to the side of the bin unit changes when the shaft is moved in the opening.

2. The apparatus of claim 1 wherein the backup means is a second jogging apparatus for simultaneously jogging the stacks of sheets from both sides of the shelves.

3. The apparatus of claim 2 wherein the jogging apparatus and backup means each include at least two, spaced side jogger rods.

4. The apparatus of claim 3 wherein the jogging apparatus further includes a back rod at the end of the shelves opposite the point of entry of the sheets into the shelves to engage the end edges of the stacks of sheets on the shelves, the back rod being connected with the source of reciprocal motion to jog against ends of the stacks.

5. The apparatus of claim 3, including a support panel above the bin unit to which the source of reciprocal motion is secured on an upper surface of the panel, and wherein the upper and lower ends of each of the jogger rods are each secured to one end of an extension arm, the opposite ends of each of the upper extension arms pivotally secured to the support panel and the lower ends pivotally secured to a lower support panel beneath the bin unit.

6. The apparatus of claim 5 wherein the sliding shaft extends across the width of the shelves above the support panel, the shaft having one end engaging the source of reciprocal motion, and the other end being free for adjustment in the opening to vary the distance between the jogger rods on opposite sides of the shelves so that the shaft is a part of the linking means; and wherein the slidable adjusting means further includes:

a pivot between the ends of the shaft;

arms secured at one end to the pivot and extending from the pivot toward opposite sides of the shelves; and means secured to the other end of each arm, operatively associated with the jogger rods to move the rods about their respective pivot points when the sliding shaft is moved.

7. The apparatus of claim 6 wherein the free end of the sliding shaft can be locked in a fixed position in the opening relative to the shelves.

8. The apparatus of claim 1, further comprising:

(a) means for counting the number of jogging cycles through which the jogging apparatus moves; and (b) means, responsive to the means for counting, for stopping the source of reciprocal motion after a predetermined number of cycles.

9. The apparatus of claim 1 wherein the linking means includes a member linking the source of reciprocal motion to at least one linking arm connected to the jogging rod and wherein the shaft is integral with the member extending from the linking arm opposite the source of reciprocal motion.

10. The apparatus of claim 6 wherein the source of reciprocal motion includes a motor which drives a cam, wherein the shaft includes a cam follower engaging the cam, and wherein bias means are connected to the shaft to bias the cam follower into contact with the cam.

11. A sheet jogging apparatus for forming uniform stacks of sheets on vertically arranged shelves of a bin unit by jogging the side edges of the sheets, comprising:

a support panel overlying the bin unit;

a source of reciprocal motion secured to the support panel;

a jogging apparatus, including jogging bars, mounted on each side of the shelves, extending the full height of the shelves, pivotally mounted for movement (1) to and from the shelves in a first position to contact and align the side edges of the stacks of sheets resting on the shelves and (2) to a second, nonjogging position away from the sides of the shelves to allow removal of the stacks of sheets therefrom;

a sliding shaft extending the width of the shelves having one end engaging the source of reciprocal motion and the other end being free for adjustment in the plane of reciprocation of the sliding shaft to vary the distance between the jogger rods, the shaft being movable in an arc about the end which engages the source of reciprocal motion;

a pivot between the ends of the shaft;

two arms secured to the pivot and extending from the pivot toward respective opposite sides of the shelves;

means secured to respective ends of the arms operatively associated with the bars to move the bars about their respective pivot points when the sliding shaft is moved;

a jogging back rod at the end of the shelves opposite the point of entry of the sheets into the shelves to engage the end edges of the stacks of sheets on the shelves for alignment thereof; and means for jogging the back rod, operatively associated with the source of reciprocal motion.

12. The apparatus of claim 11, including means to fix the position of the free end of the sliding shaft relative to the end of the sliding shaft engaging the source of reciprocal motion.

13. The apparatus of claim 12 further comprising:

(a) means for counting the number of jogging cycles through which the jogging apparatus and back rob moves; and (b) means, responsive to the means for counting, for stopping the source of recipocal motion after a predetermined number of cycles.

14. The apparatus of claim 13 wherein the means for counting includes a microswitch to sense the jogging cycles and a microprocessor to count the cycles, thereby allowing a plurality of jogs for each activation of the source of reciprocal motion.

15. The apparatus of claim 12 wherein the free end of the shaft extends through an opening in the side of the bin unit, and wherein the source of reciprocal motion, the shaft, the pivot, and the arms are all mounted above the support panel.

16. The apparatus of claim 15 wherein the position of the free end of the shaft in the opening determines the static separation between the jogging bars on opposite sides of the shelves.

17. The apparatus of claim 16 wherein the source of reciprocal motion includes an eccentric cam and wherein the apparatus further comprises means for biasing the shaft into contact with the cam.

* * * * *